US005979339A

United States Patent [19]

Smith

[11] Patent Number: 5,979,339

[45] Date of Patent: Nov. 9, 1999

[54] LOCK BOX APPARATUS ADAPTED FOR USE WITH LICENSE PLATE MOUNTING STRUCTURES

[76] Inventor: Jerry R. Smith, 5690 W. Rowland Ave., Littleton, Colo. 80123

[21] Appl. No.: 08/668,835

[22] Filed: Jun. 24, 1996

Related U.S. Application Data

[62] Division of application No. 08/154,259, Nov. 18, 1993, Pat. No. 5,528,998.

[51] Int. Cl.[6] ..... E05G 1/00

[52] U.S. Cl. ..... 109/50; 109/29; 109/34; 109/45; 70/63; 70/456 R

[58] Field of Search ..... 109/22–25, 29, 109/33, 34, 45, 50–52, 54; 70/57, 58, 63, 158–162, 312, 315, 456 R; 220/343, 476, 480; 206/37.1, 335; 224/517, 557; 40/200–202, 209

[56] References Cited

U.S. PATENT DOCUMENTS

| | | | |
|---|---|---|---|
| 1,573,113 | 2/1926 | Irie | 40/201 |
| 2,921,395 | 1/1960 | Fishman | 40/209 |
| 3,312,010 | 4/1967 | Bartolone | 40/209 |
| 3,340,640 | 9/1967 | Savage | 40/209 |
| 3,702,510 | 11/1972 | Genyk et al. | 40/209 |
| 3,867,823 | 2/1975 | Waltower | 70/63 X |
| 4,182,062 | 1/1980 | Krokos et al. | 40/209 |
| 4,722,823 | 2/1988 | Mareels et al. | 109/25 X |
| 5,012,602 | 5/1991 | Storey | 40/209 X |
| 5,404,664 | 4/1995 | Brooks et al. | 40/209 X |
| 5,528,998 | 6/1996 | Smith | 109/50 |

FOREIGN PATENT DOCUMENTS

| | | | |
|---|---|---|---|
| 2627497 | 12/1977 | Germany | 40/201 |
| 661012 | 6/1987 | Switzerland | 40/209 |
| 682898 | 12/1993 | Switzerland | 40/209 |
| 2266986 | 11/1993 | United Kingdom | 40/202 |

*Primary Examiner*—Suzanne Dino Barrett
*Attorney, Agent, or Firm*—Timothy J. Martin; Michael R. Henson

[57] ABSTRACT

A lock box assembly is mountable to a vehicle to receive an item to be protected and to affix a license plate thereto. The lock box apparatus comprises an elongated housing formed by an anchoring plate and a door and having an interior sized to receive the protected item. The anchoring plate has a pair of anchoring holes that are alignable with installation holes on the vehicle so that the anchoring plate may be mounted to the vehicle. The door is pivotally mounted to the anchoring plate between a closed position enclosing the interior and preventing access to the protected item and an opened position exposing the interior and permitting access to the protected item. The door is provided with a pair of door holes registerable with cooperative holes in the license plate so that the license plate may be affixed thereto. A latching assembly latches the door to the anchoring plate and has a secured state whereby the door is disposed in the closed position and an unsecured state whereby the door is movable between the closed and opened positions thereby to allow access to the protected item.

9 Claims, 4 Drawing Sheets

LOCK BOX APPARATUS ADAPTED FOR USE WITH LICENSE PLATE MOUNTING STRUCTURES

This application is a division of my U.S. patent application Ser. No. 08/154,259, filed Nov. 18, 1993 and entitled Lock Box Apparatus, now U.S. Pat. No. 5,528,998 issued Jun. 25, 1996.

FIELD OF INVENTION

The present invention is directed to a lock box apparatus which is adapted for mounting onto a motor vehicle's license plate mounts to secure a protected item, such as a spare key. The lock box apparatus of the present invention is particularly adapted to be mounted behind the license plate to hide the lock box apparatus from view of the general public.

BACKGROUND OF THE INVENTION

Security has been a concern for people over the centuries. As early as four thousand years ago, ancient Egyptians used wooden pin-tumbler type locks to secure their doors. Even today, practically everyone who lives in a residential dwelling and/or operates a motor vehicle is concerned with the security of their person and property. A motorist typically locks the doors on his vehicle when leaving it unattended in an unsecured place. Sometimes a problem arises when the doors on a motor vehicle can be locked without using a key. Unfortunately, these types of locking doors can potentially lock a person out of his vehicle if that person is not presently carrying the appropriate key. For example, this may occur when the motorist manually manipulates the locks on his car doors into the locked state then inadvertently closes the locked doors while leaving his keys in the ignition or passenger compartment.

Locking oneself out of one's own motor vehicle is often quite frustrating, extremely inconvenient, time consuming and costly. One option of gaining entry into a locked motor vehicle is to break a window to provide access thereinto. Another option would be to call a locksmith, if a telephone is readily available, so that entry into the motor vehicle can be gained without incurring costly damage. Nonetheless, the costs attendant to persons who have inadvertently locked themselves out of their vehicles is surprisingly large. Figures reported by the American Automobile Association indicate that it alone spent in excess of $400 million during 1992 to assist motorists who had locked themselves out of their own motor vehicles. This figure does not include what was spent by other automobile clubs, police, and private citizens and further relates only to automobile entry, not homes or businesses.

To resolve this long standing problem of locking oneself out of his/her motor vehicle, the most cautious motorist sometimes carries a spare door key in a wallet or purse. Occasionally, the motorist will place a door key in a metal or plastic container that has a magnet which can secure the container to any metal portion of the motor vehicle. However, while the motor vehicle is moving, any jarring force or vibration could cause this container to fall off of the vehicle. Another method of addressing the problem of locking oneself out of his own vehicle is by using a keypad whereby the motorist enters an appropriate code to electronically release the locks. However, such a method is very costly and usually requires the manufacturer to install this device at the factory while the vehicle is being assembled.

Therefore, a long felt need exists to provide a convenient and inexpensive way for a person who has locked himself out of his vehicle to gain access thereto. The most convenient and simplest way of satisfying this need is to provide a spare key to the person locked out of his motor vehicle. It would be advantageous if this key be can secured into a lock box which is fixably mounted to the vehicle in order to prevent theft of the lock box apparatus and key. It would be further advantageous that such a lock box apparatus be sufficiently small so that it could be hidden from view of the general public. The present invention is directed to such a lock box.

SUMMARY OF INVENTION

It is an object of the present invention to provide a new and useful lock box apparatus which is adapted for mounting onto a mounting structure to secure a protected item such as a key thereto.

It is a further object of the present invention to provide a lock box apparatus which is adapted for mounting onto a mounting structure for a license plate of a motor vehicle to secure a spare key thereto.

It is another object of the present invention to provide a lock box apparatus which is sized to be mounted behind a license plate of a motor vehicle and hidden from view of the general public.

Still a further object of the present invention is to provide a lock box apparatus which is relatively small for the purpose of securing a small protected item therein.

Yet another object of the present invention is to provide a lock box apparatus which can also secure a frangible ampule containing a defiling fluid so that upon breaching security of the lock box apparatus, the ampule fractures and releases the defiling fluid onto the protected item to deter its theft or use.

The lock box apparatus of the present invention is adapted for mounting onto a mounting structure for a license plate of a motor vehicle to secure a protected item, such as a spare key, thereto. Typically, the license plate has a pair of spaced-apart license holes which are disposed in a margin portion of the license plate. The mounting structure has a pair of spaced-apart installation holes adapted to register with the pair of license plate holes and to matably receive a respective one of a pair of mounting fasteners.

The present invention broadly comprises an elongated housing formed by an anchoring plate and, a door and a latching assembly. The elongated housing has an interior sized to receive the protected item, the mounting fasteners and a pair of license plate fasteners. The anchoring plate has a first pair of anchoring holes extending therethrough which are adapted to receive the mounting fasteners so that when the pair of installation holes and the anchoring holes register with each other, each mounting fastener can extend through registered ones of the installation holes and anchoring holes and be fastened thereby installing the housing onto the mounting structure.

The door is pivotally mounted to the anchoring plate and operates to move between a closed position to enclose the interior thereby preventing access to the protected item and the mounting fasteners, and an opened position to expose the interior thereby permitting access to the protected item and the mounting fasteners. The door has a pair of door holes extending therethrough and adapted to receive a respective one of the license plate fasteners so that, when the pair of door holes and the license plate holes register with each other, each license plate fastener can extend through register ones of the door holes and license plate holes and be fastened thereby affixing the license plate to the door. The door holes are preferably slots so that the license plate fasteners and the license plate are movable relative to the door between a first position for sealing the lock box apparatus and a second position partially exposing the lock box apparatus.

The latching assembly is adapted to latch to the door and the anchoring plate. This latching assembly has a secured state whereby the door is disposed onto the anchoring plate in the closed position thereby preventing access to the protected item and the mounting fasteners within the interior of the housing, and an unsecured state whereby the door is movable between the closed and open positions thereby allowing access to the protected item and the mounting fasteners within the housing interior.

Preferably, the latching assembly includes a latch member operative with an array of rotatable locking elements so that when the array of locking elements is rotated into a select combination of locking element positions, the latch member is enabled to reciprocally slide thereby enabling the latch assembly to move between the secured state and the unsecured state. Further, when the array of locking elements is rotated into a random combination of locking element positions different from the selected combination of locking element positions, the latch member is prevented from reciprocally sliding thereby rendering the latch assembly in the secured state.

The latch member may include at least one bolt element operative to extend into matable engagement with at least one door bolt receiver when the door is in the closed position to provide the secured state and to retract from matable engagement with the door bolt receiver when the door is in the closed position to provide the unsecured state. It is also preferred that the latch member includes a plurality of pawl elements operative in cooperation with the array of locking elements so that when the array of locking elements is rotated into a select combination of locking element positions, each of the plurality of pawl elements can be simultaneously received by a respective detent formed into each locking element to enable the latch member to reciprocally slide. Thus, when the array of locking elements is rotated into a random combination of locking element positions different from the select combination of locking element positions, the plurality of pawl elements is immovable thereby preventing the latch member from reciprocally sliding.

Each of the array of locking elements may be formed as a lock dial with this array of lock dials rotatably connected to one of the door and the anchoring plate. The locking elements preferably include indicia to indicate one of the select combination of locked dial positions and the random combination of locked dial positions.

The lock apparatus of the present invention may also include a frangible ampule containing a defiling fluid. This ampule may be disposed within the housing proximate to the protective item so that, upon breaching security of the lock box apparatus, the ampule fractures thereby releasing the defiling fluid onto the protected item. These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENT

The present invention generally concerns a lock box apparatus which is adapted for mounting onto a mounting structure to secure a protected item thereto. The ensuing description of the exemplary embodiment of a lock box apparatus of the present invention specifically relates to a lock box apparatus adapted for mounting onto a mounting structure such as one for a license plate of a motor vehicle. One of ordinary skill in the art would appreciate, however, that the present invention has other applications other than those described herein and can protect other items, particularly those which are small. Generally, the broad form of the present invention includes a housing, a door, and a lockable latching assembly to secure the door to the housing in a secured state.

Figure 1:
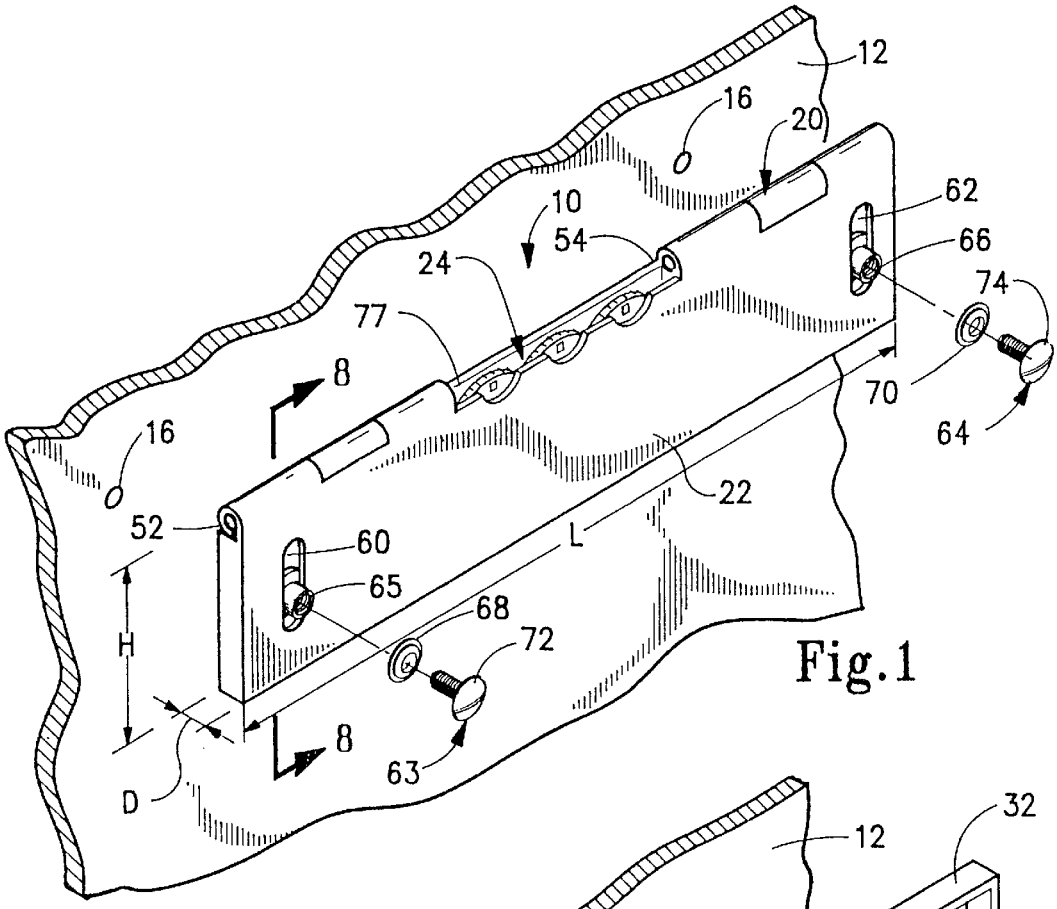
FIG. 1 is a perspective view of a lock box apparatus according to the present invention shown with its door in a closed position and displaced from a mounting structure.
Figure 2:
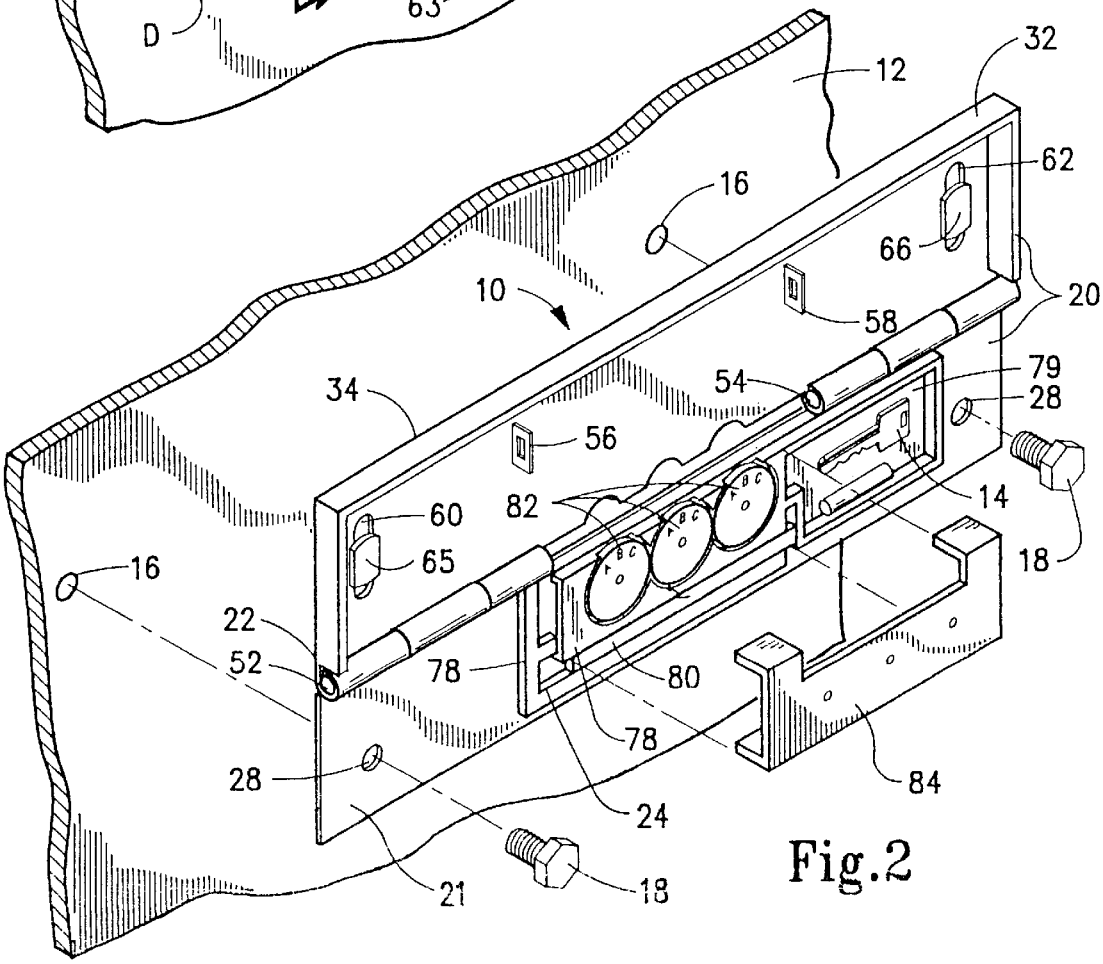
FIG. 2 is a perspective view of a partially exploded lock box apparatus of FIG. 1 shown with its door in an opened position and displaced from the mounting structure.

The lock box apparatus 10 according to the present invention is generally shown in FIGS. 1–9. With reference to FIGS. 1 and 2, lock box apparatus 10 is adapted for mounting onto a mounting structure 12 to secure a protected item 14 thereto. For purposes of example only, protected item 14 is a conventional key. Mounting structure 12 has a pair of installation holes 16 which are adapted to receive a respective mounting fastener 18 (FIG. 2) in a matable relationship to retain lock box apparatus 10 onto mounting structure 12.

Lock box apparatus 10 includes a housing 20 formed by an anchoring plate 21 and a door 22 and a latching assembly 24 operably connected to housing 20. Housing 20 has an interior 26 which is sized to receive protected item 14 and fasteners 18. Anchoring plate 21 has a pair of anchoring holes 28 which extend therethrough. The pair of anchoring holes 28 of anchoring plate 21 are located such that respective ones of anchoring holes 28 and installation holes 16 of mounting structure 12 can register with one another. Anchoring holes 28 are sized and adapted to receive fasteners 18 so that, when respective ones of installation holes 16 and anchoring holes 28 register, a respective one of fasteners 28 can extend through anchoring hole 28 and into installation hole 16 to install housing 20 onto mounting structure 12. As best shown in FIG. 1, housing 20 is elongated and length "L", a depth "D" and a height "H". Depending upon the specific application for lock box apparatus 10 of the present invention, "L", "D" and "H" can vary throughout a range of dimensions. However, it is preferable that housing 20 has a length "L" in a range of 7.6 centimeters (about 3.0 inches) and 30.5 (about 12.0 inches); a depth "D" in a range of 0.6 centimeters (about 0.25 inches) and 3.8 centimeters (about 1.5 inches); and a height "H" in a range of 1.9 centimeters (about 0.75 inches) and 5.1 centimeters (about 2.0 inches).

Figure 3:
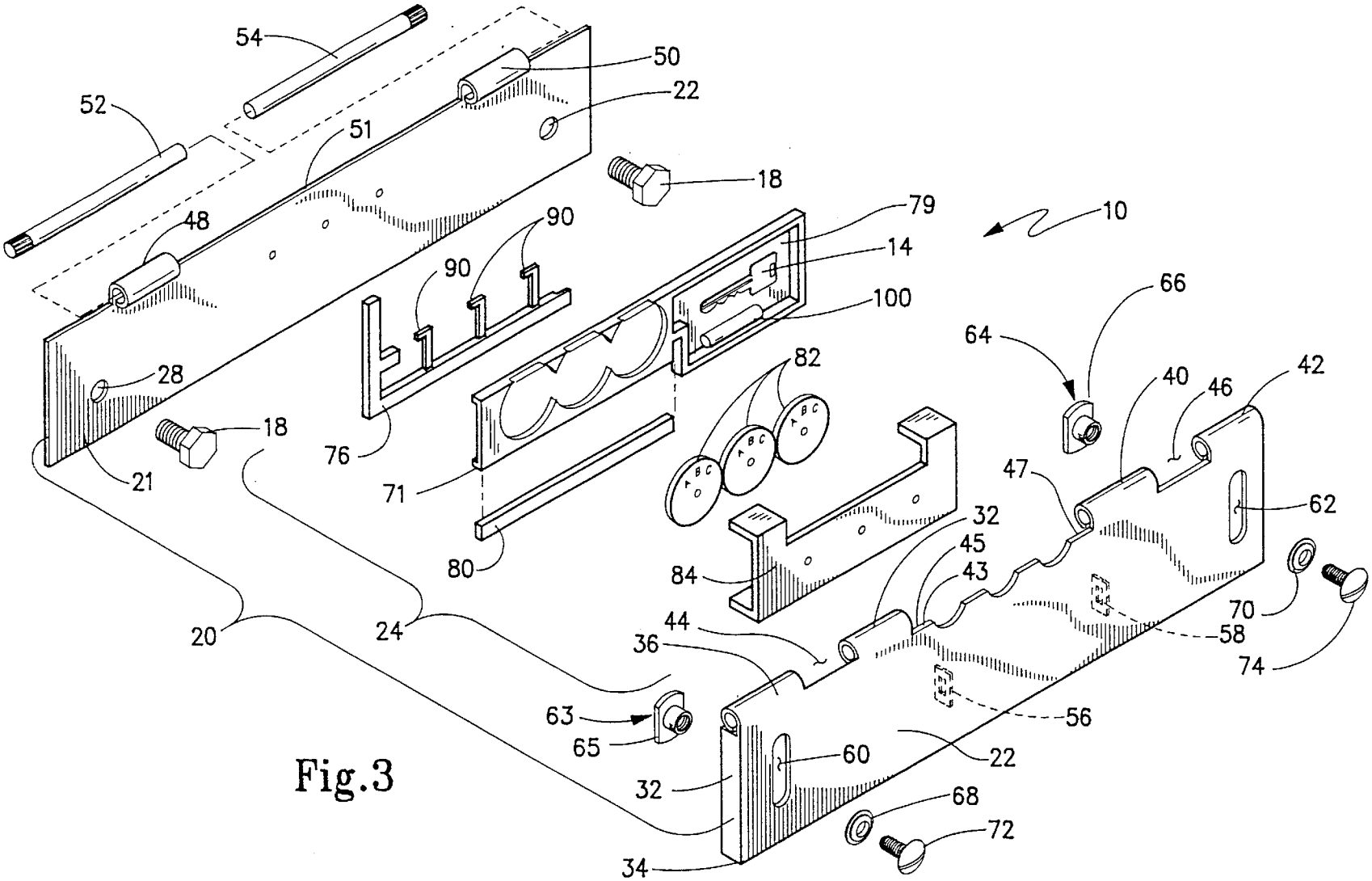
FIG. 3 is an exploded perspective view of the lock box apparatus shown in FIGS. 1 and 2.

With reference to FIGS. 2 and 3, housing 20 includes an anchoring plate 21 and door 22 having an upright sidewall 32 which is rigidly attached to and extends from a peripheral edge portion 34 of door 22. One ordinary skilled in the art would appreciate that sidewall 32 provides strength and rigidity to door 22. One of ordinary skill in the art would further appreciate that sidewall 32 could just as easily be disposed on anchoring plate 21 as opposed to door 22 to define housing 20 having interior 26.

Door 22 is connected to anchoring plate 21 and is operative to move between a closed position (FIG. 1) and an opened position (FIG. 2). In the closed position, interior 26 is enclosed thereby preventing access to protected item 14 and fasteners 18. In the opened position, interior 26 is exposed thereby permitting access to protected item 14 and fasteners 18. As shown in FIG. 3, door 22 includes a first pair of barrel elements 36, 38 and a second pair of barrel elements 40, 42, all of which being axially aligned along a longitudinal edge 43 of door 22. The first pair of barrel elements 36, 38 are disposed at a proximal end 45 of door 22 and the second pair of barrel elements 40, 42 are disposed at a distal end 47 of door 22. Each pair of barrel elements 36, 38 and 40, 42 is positioned in a spaced-apart relationship to define respective openings 44, 46 therebetween. A pair of knuckle elements 48, 50 connected to anchoring plate 21 along an anchoring edge 57 of anchoring plate 21 are axially aligned with one another. Knuckle elements 48, 50 are disposed in a manner such that respective ones of openings 44, 46 receive a respective one of knuckle elements 48, 50. A respective one of a pair of pivot pins 52, 54 can then be inserted through barrel elements 32, 36 and knuckle element 48 and barrel elements 40, 42 and knuckle element 50 so that door 22 can pivot between the closed position and the opened position shown in FIGS. 1 and 2.

Door 22 includes a pair of door bolt receivers 56, 58, which are described in more detail below, and a pair of spaced-apart slots 60, 62. Each of slots 60, 62 is sized to slidably receive a respective one of a license plate fastener 63, 64. Each license plate fastener 63, 64 includes a respective female portion 65, 66 which is adapted to receive a respective spring washer 68, 70 and a respective male portion 72, 74.

Figure 4:
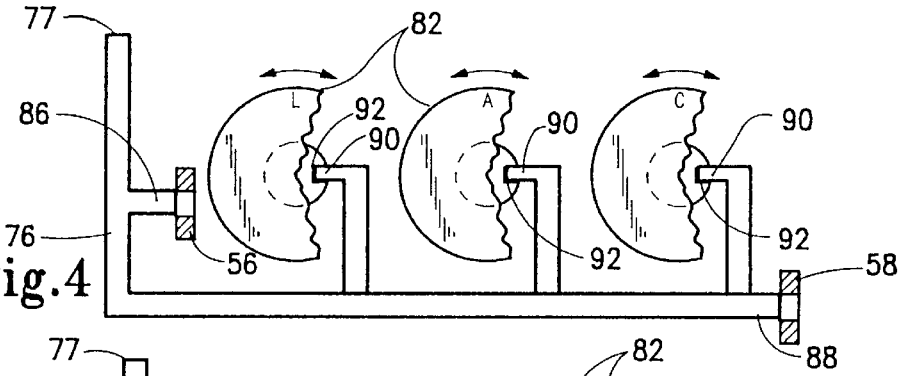
FIG. 4 is a front view in elevation of a latching assembly having an array of rotatable locking elements partially broken away and shown in an unsecured state.
Figure 5:
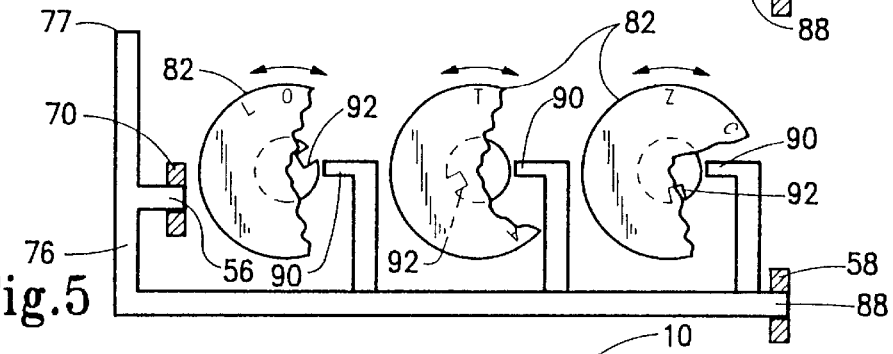
FIG. 5 is a front view in elevation of a latching assembly having an array of rotatable locking elements partially broken away and shown in a secured state.
Figure 6:
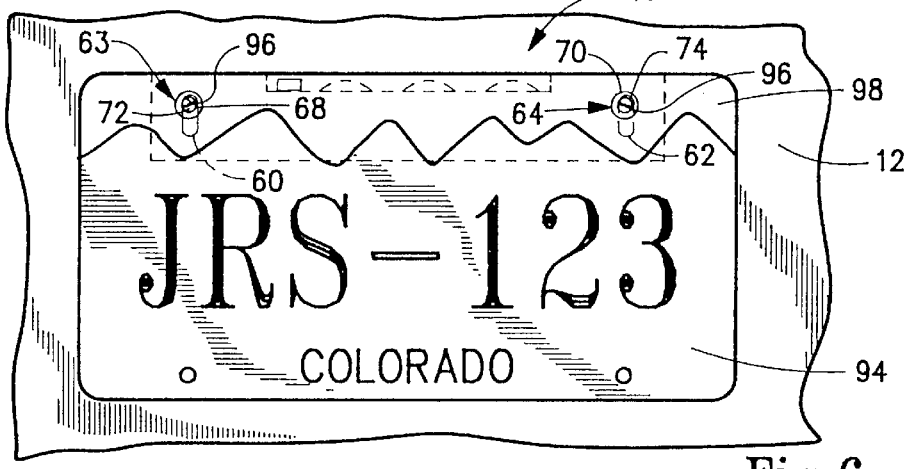
FIG. 6 is a front view in elevation of the lock box apparatus of FIGS. 1–3 drawn in phantom to show it hidden from view of the general public behind a conventional license plate of a motor vehicle.
Figure 7:
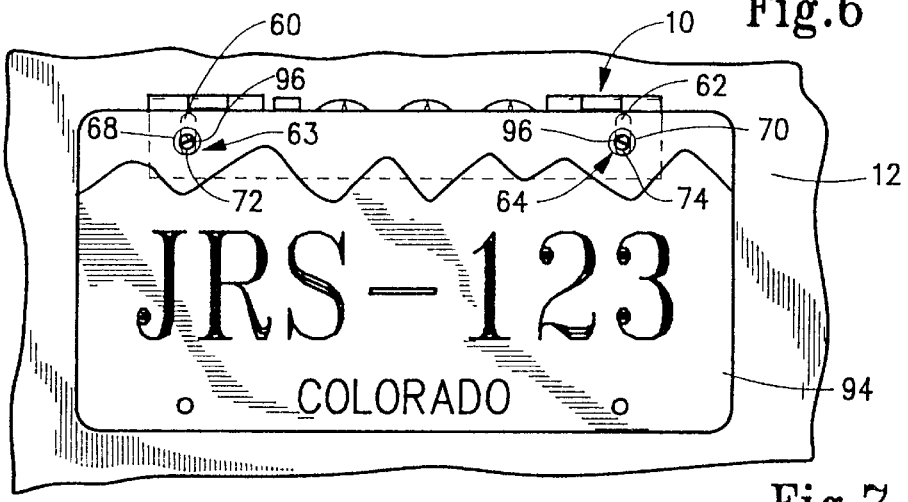
FIG. 7 is a front view in elevation of the lock box apparatus of FIG. 6 shown partially exposed from being hidden behind the conventional license plate of the motor vehicle.

As best shown in FIGS. 3–5 latching assembly 24 includes a latch member 76, a frame structure 78, a support structure 80, an array of locking elements 82 and a cover plate 84. Latching assembly 24 is adapted to latch door 22 to anchoring plate 21 and has an unsecured state as shown in FIG. 4 and a secured state as shown in FIG. 5. In the unsecured state, door 22 is movable between the closed position (FIG. 1) and opened position (FIG. 2) thereby allowing access to protected item 14 and mounting fasteners 18 within interior 26 of housing 20. In the secured state, door 22 is disposed onto anchoring plate 21 in the closed position (FIG. 1) thereby preventing access to protected item 14 and mounting fasteners 18 within interior 26 of housing 20.

Latching assembly 24 also includes latch member 76 which is operative with the array of locking elements 82. When the array of locking elements 82 is rotated into a select combination of locking element positions, latch member 76 is enabled to reciprocally slide thereby enabling latch assembly 24 to move between the secured state and the unsecured state. As shown by way of example in FIG. 4, the array of locking elements 82 is rotated into the select combination of locking element positions "L-A-C" thereby enabling latch member 76 to reciprocally slide. When the array of locking elements 82 is rotated into a random combination of locking element positions different from the select combinations of locking element positions, latch member 76 is prevented from reciprocally sliding thereby rendering latch assembly 24 in the secured state. As shown by way of example in FIG. 5, the array of locking elements 82 is rotated into a random combination of locking element positions "O-T-Z" thereby preventing latch member 76 from reciprocally sliding between the secured and unsecured states.

Latch member 76 further includes a pair of bolt elements 86, 88 which are operative to extend into matable engagement with a respected one of door bolt receivers 56, 58 when door 22 is in the closed position (FIG. 1) to provide the secured state as shown in FIG. 5. The pair of bolt elements 86, 88 are operative to retract from matable engagement with respective ones of door bolt receivers 56, 58 when door 22 is in the closed position to provide the unsecured state as shown in FIG. 4. One of ordinary skill in the art would appreciate that a single bolt element operative with a single door bolt receiver would be sufficient to provide the secured and unsecured states described above.

With reference to FIGS. 3, 4 and 5, latch member 76 includes a plurality of pawl elements 90 which are operative in cooperation with the array of locking elements 82. When the array of locking elements 82 is rotated in the select combination of locking element positions, as shown by "L-A-C" of FIG. 4, each of pawl elements 90 can be simultaneously received by a respective detent 92 formed into each locking element 82 to enable latch member 76 to reciprocally slide by manual movement of ribbed head 77 which is accessible as shown in FIG. 1. When the array of locking elements is rotated into the random combination of locking element positions, as shown for example by "O-T-Z" of FIG. 5, which is different from the select combinations of locking element positions "L-A-C" of FIG. 4, the plurality of pawl elements 90 is immovable thereby preventing latch member 76 from reciprocally sliding. For purposes of the present invention, each of the array of locking elements 82 is a conventional lock dial being rotatably connected to either anchoring plate 21 or door 22. Further, each of the array of locking elements 82 includes indicia to indicate whether the array of locking elements 82 are either in the select combination of locking element positions such as "L-A-C" of FIG. 4 or the random combination of locking element positions such as "O-T-Z" of FIG. 5. Also, for purposes of the present invention, alphabetical indicia have been selected although numerical or alphanumerical indicia could also have been used.

Operation of the lock box apparatus 10 is shown in FIGS. 6–9. Lock box apparatus 10 is adapted for mounting onto mounting structure 12 for license plate 94, and license plate 94 is adapted to be affixed to lock box apparatus 10. License plate 94 has a pair of spaced-apart license plate holes 96 disposed in a margin portion 98 of license plate 94. As described above, mounting structure 12 has a pair of spaced-apart installation holes 16 adapted to matably receive a respective one of the pair of mounting fasteners 18. Housing 22 shown elongated has interior 26 sized to receive protected item 14, mounting fasteners 18 and a pair of license plate fasteners 63, 64. The pair of anchoring holes 28 are adapted to receive a respective one of mounting fasteners 18 so that when the pairs of installation holes 16 and anchoring holes 28 register with each other, each mounting fastener 18 can extend through registered ones of the installation holes 16 and anchoring holes 28 and be fastened thereby mounting housing 20 onto mounting structure 12.

Figure 9:
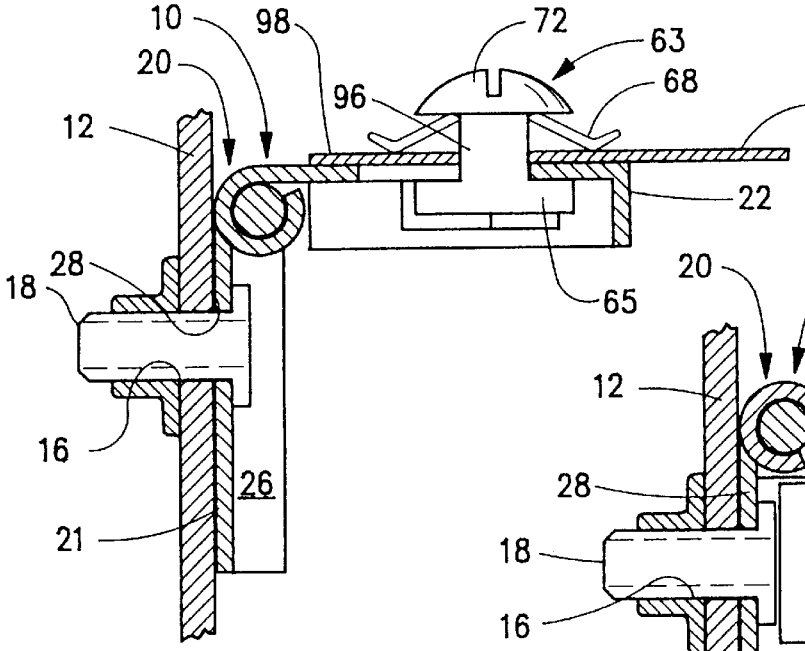
FIG. 9 is an enlarged side view in cross-section of the lock box apparatus of FIG. 8 shown with its door in the opened position.
Figure 8:
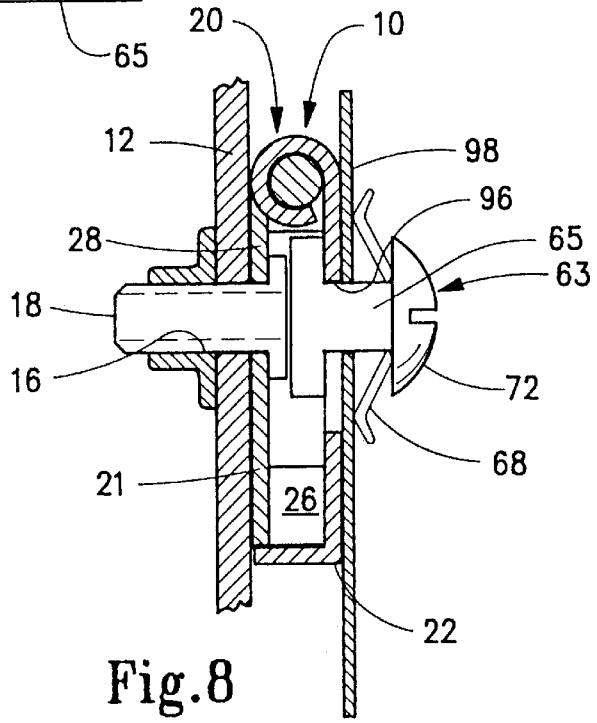
FIG. 8 is an enlarged side view in cross-section taken along lines 8—8 of the lock box apparatus shown in FIG. 1 and connected to the license plate as shown in FIG. 6.

Door 22 is pivotally mounted to anchoring plate 21 and is operative to move between the closed position (FIG. 8) and the opened position (FIG. 9). In the closed position, interior 26 is enclosed thereby preventing access to protected item 14 and mounting fasteners 18. In the opened position, interior 26 is exposed thereby permitting access to protected item 14 and mounting fasteners 16. Door 22 has a pair of door holes 60, 62 extending therethrough. The pair of door holes 60, 62 shown as slots are adapted to receive a respective one of license plate fasteners 63, 64 so that, when the pair of door holes 60, 62 and license plate holes 96 register with each other, license plate fasteners 63, 64 can extend through registered ones of door holes 60, 62 and license plate holes 96 and be fastened thereby affixing license plate 94 to door 22. License plate fasteners 63, 64 are fastened when female portions 65, 66 matably receive a respective one of male portions 72, 74 as shown in FIGS. 8 and 9.

Although not by way of limitation, the pair of door holes 60, 62 are slots so that license plate fasteners 63, 64 and license plate 94 are movable relative to door 22 between a first position (FIGS. 6 and 8) hiding lock box apparatus 10 behind license plate 94 and a second position (FIGS. 7 and 9) partially exposing lock box apparatus 10 from behind license plate 94. While behind license plate 94 in the first position, lock box apparatus 10 is hidden from view of the general public. While behind license plate 94 in the second position, lock box apparatus 10 is partially exposed in view of the general public. Disposing a respective spring washer 68, 70 between license plate 94 and license plate fasteners 63, 64 provides a sufficient resilient frictional force between license plate 94 and door 22 so that license plate 94 could be retained in the first and second positions or anywhere therebetween.

Figure 10:
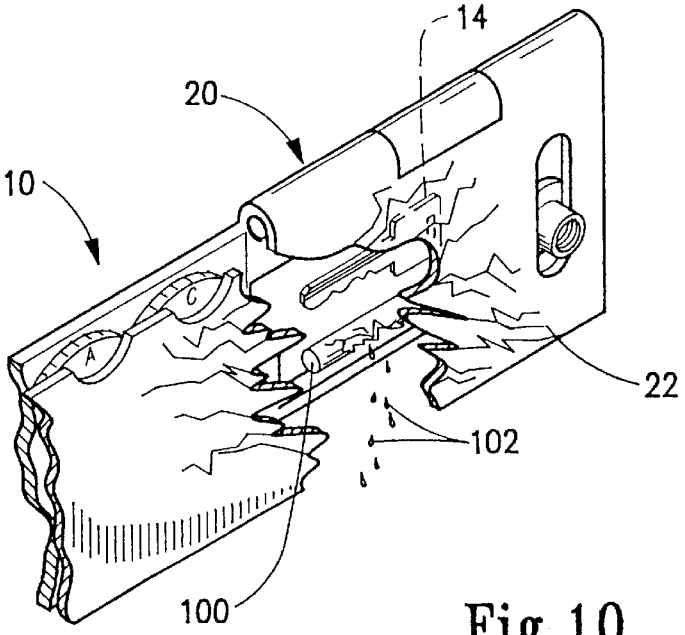
FIG. 10 is a partial perspective view of the lock box apparatus of the present invention shown smashed with a fractured ampule of defiling fluid.

Some vehicle manufacturers provide the motorist with a pair of keys. Typically, one key is for the ignition and the other key is for both the door locks and the trunk lock. To best utilize the lock box apparatus 10 of the present invention, it is intended that the door/trunk key be the protected item within lock box apparatus 10. Then, the ignition key can be hidden in either the passenger compartment or the trunk if needed when the motorist is locked out of his vehicle. Other vehicle manufacturers provide only a single key for ignition, door locks and trunk. This could be inviting to a car thief having this information. It is then recommended that a frangible ampule 100 containing a defiling fluid 102 be disposed within housing 20 proximate protected item 14 so that, upon breaching security of lock box apparatus 10, frangible ampule 100 fractures thereby releasing the defiling fluid 102 onto the protected item. For example, smashing lock box apparatus 10 as shown in FIG. 10 also fractures ampule 100 which, in turn, releases defiling fluid 102 onto protected item 14. An odoriferous fluid, glue or acid are examples of defiling fluids which mig deter criminal actions of a car thief. Moreover, it may be desirable that the key be constructed of a plastic material and defiling fluid 102 be a fast acting solvent which can quickly destroy the operability of the key.

From the detailed description above, a skilled artisan would comprehend that the lock box apparatus 10 of the present invention could be affixed to license plate holes located in a bottom margin portion of the license plate. Inverting lock box apparatus 10 would facilitate its use in this manner.

From the above description, then, it may be appreciated that the lock box apparatus of the present invention satisfies the need to provide a convenient and inexpensive way for a person who has locked himself out of his home or vehicle to gain access thereto. The lock box apparatus is sized to be hidden either behind a license plate of a motor vehicle. Since the lock box apparatus is designed to protect small items such as keys, the lock box itself is relatively small. Where further security may be required, a frangible ampule containing a defiling fluid may be placed proximate the protected item so that if security is breached, the ampule fractures to contaminate the protected item.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A lock box apparatus adapted for mounting onto a mounting structure for a license plate of a motor vehicle and for affixing the license plate thereto, the license plate having a pair of spaced apart license plate holes disposed in a margin portion of the license plate, the mounting structure having a pair of spaced apart installation holes adapted to register with the pair of license plate holes and to matably receive a respective one of a pair of mounting fasteners, the lock box apparatus comprising:

(a) an elongated housing formed by an anchoring plate and a door and having an interior sized and adapted to receive an item to be protected, the mounting fasteners and a pair of license plate fasteners, said anchoring plate having a first pair of anchoring holes extending therethrough and adapted to receive the mounting fasteners so that, when the pair of installation holes and anchoring holes register with each other, each mounting fastener can extend through registered ones of the installation holes and anchoring holes and be fastened thereby installing said housing onto the mounting structure, said door pivotally mounted to said anchoring plate and operative to move between a closed position to enclose said interior thereby preventing access to the item to be protected and the mounting fasteners and an opened position to expose said interior thereby permitting access to the item to be protected and the mounting fasteners, said door having a pair of door holes extending therethrough which are sized and adapted to receive a respective one of the license plate fasteners whereby the pair of door holes and license plate holes may be registered with each other so that each license plate fastener may extend through registered ones of the door holes and license plate holes and be fastened thereby to affix the license plate to said door in such a manner that said door may be concealed from view; and (b) a latching assembly permanently disposed within said interior, said latching assembly adapted to latch said door to said anchoring plate, said latching assembly having a secured state whereby said door is disposed onto said anchoring plate in the closed position thereby preventing access to the item to be protected and the mounting fasteners within said interior of said housing and an unsecured state whereby said door is movable between the closed and opened positions thereby allowing access to the item to be protected and the mounting fasteners within said interior of said housing.

2. A lock box apparatus according to claim 1 wherein said pair of door holes are slots so that the license plate fasteners and the license plate are movable relative to said door between a first position concealing said lock box apparatus and a second position partially exposing said lock box apparatus.

3. A lock box apparatus according to claim 1 wherein said housing includes an upright sidewall rigidly attached to and extending from a peripheral edge portion of one of said door and anchoring plate.

4. A lock box apparatus according to claim 1 wherein said latching assembly includes a latch member operative with an array of rotatable locking elements so that when said array of locking elements is rotated into a select combination of locking element positions, said latch member is enabled to reciprocally slide thereby enabling said latch assembly to move between the secured state and the unsecured state and when said array of locking elements is rotated into a random combination of locking element positions different from said select combination of locking element positions, said latch member is prevented from reciprocally sliding thereby rendering said latch assembly in the secured state.

5. A lock box apparatus according to claim 4 wherein said latch member includes at least one bolt element operative to extend into matable engagement with at least one door bolt receiver when said door is in the closed position to provide the secured state and to retract from matable engagement with said door bolt receiver when said door is in the closed position to provide the unsecured state.

6. A lock box apparatus according to claim 4 wherein said latch member includes a plurality of pawl elements operative in cooperation with said array of locking elements so that when said array of locking elements is rotated into a select combination of locking element positions, each of said plurality of pawl elements can be simultaneously received by a respective detent formed into each locking element to enable said latch member to reciprocally slide and when said array of locking elements is rotated into a random combination of locking element positions different from said select combination of locking element positions, said plurality of pawl elements is immovable thereby preventing said latch member from reciprocally sliding.

7. A lock box apparatus according to claim 6 wherein each of said array of locking elements is a lock dial, said array of lock dials rotatably connected to one of said door and said anchoring plate.

8. A lock box apparatus according to claim 4 wherein each of said array of locking elements includes indicia to indicate one of the select combination of lock dial positions and the random combination of lock dial positions.

9. A lock apparatus according to claim 1 including a frangible ampule containing a defiling fluid, said ampule disposed within said housing proximate to the protected item so that, upon breaching security of said lock box apparatus, said ampule fractures thereby releasing the defiling fluid onto the protected item.

* * * * *